US005343830A

United States Patent [19]

Alexander et al.

[11] Patent Number: 5,343,830

[45] Date of Patent: Sep. 6, 1994

[54] CIRCULATING FLUIDIZED BED REACTOR WITH INTERNAL PRIMARY PARTICLE SEPARATION AND RETURN

[75] Inventors: Kiplin C. Alexander, Wadsworth; Felix Belin, Brecksville; David E. James, Barberton; David J. Walker, Wadsworth, all of Ohio

[73] Assignee: The Babcock & Wilcox Company, New Orleans, La.

[21] Appl. No.: 37,986

[22] Filed: Mar. 25, 1993

[51] Int. Cl.[5] ..... F22B 1/00

[52] U.S. Cl. ..... 122/4 D; 110/245; 165/104.16; 422/145; 422/147

[58] Field of Search ..... 122/4 D; 110/245, 216; 165/104.16; 422/145, 147; 55/429, 444

[56] References Cited

U.S. PATENT DOCUMENTS

| | | | |
|---|---|---|---|
| 2,083,764 | 6/1937 | Weisgerber | 183/110 |
| 2,163,600 | 6/1939 | How | 183/110 |
| 3,759,014 | 9/1973 | Van Dyken, II et al. | 55/96 |
| 4,165,717 | 8/1979 | Reh et al. | 122/4 D |
| 4,253,425 | 3/1981 | Gamble et al. | 122/4 D |
| 4,532,871 | 8/1985 | Van Gasselt et al. | 110/216 |
| 4,538,549 | 9/1985 | Stromberg | 122/4 D |
| 4,589,352 | 5/1986 | Van Gasselt et al. | 110/216 |
| 4,640,201 | 2/1987 | Holmes et al. | 110/245 |
| 4,672,918 | 6/1987 | Engstrom et al. | 122/4 D |
| 4,679,511 | 9/1987 | Holmes et al. | 110/216 |
| 4,683,840 | 8/1987 | Morin | 122/4 D |
| 4,699,068 | 10/1987 | Engstrom | 110/216 |
| 4,708,092 | 11/1987 | Engstrom | 122/4 D |
| 4,717,404 | 1/1988 | Fore | 55/444 |
| 4,730,563 | 3/1988 | Thornblad | 110/216 |
| 4,732,113 | 3/1988 | Engstrom | 122/4 D |
| 4,770,237 | 8/1988 | Morin et al. | 165/104.16 |
| 4,891,052 | 1/1990 | Belin et al. | 55/429 |
| 4,915,061 | 4/1990 | Garcia-Mallol | 122/4 D |
| 4,992,085 | 2/1991 | Belin et al. | 55/444 |
| 5,025,755 | 6/1991 | Eickvonder et al. | 122/4 D |
| 5,060,599 | 10/1991 | Chambert | 12/4 D |
| 5,117,770 | 6/1992 | Hassinen | 110/245 |
| 5,167,932 | 12/1992 | Ruottu | 122/4 D |

FOREIGN PATENT DOCUMENTS 349915 6/1931 United Kingdom .

OTHER PUBLICATIONS

"Circulating Fluidized Bed Boiler Solids System with In-Furnace Particle Separator", Belin & Flynn, Proceedings of the 1991 International Conference on Fluidized Bed Combustion-Montreal, Canada-Apr. 21-24, pp. 287-294.

"Coal-Fired CFB Boilers-Babcock & Wilcox's Experience", Belin, Price & Warrick, Presented to International Joint Power Generation Conference-San Diego, Calif.-Oct. 6-10, 1991-entire paper.

"Babcock & Wilcox Circulating Fluidized Bed Boiler Refinements," Walker, Presented to Council of Industrial Boiler Owners, Fluid Bed VII Seminar, Indianapolis, Ind.-Dec. 8-10, 1991-20 pages.

*Primary Examiner*—Edward G. Favors

*Attorney, Agent, or Firm*—Robert J. Edwards; Eric Marich

[57] ABSTRACT

A CFB reactor or combustor having an internal impact type primary particle separator provides cavity means and particle return means in an upper portion of the reactor enclosure to obtain direct and internal return of all primary collected solids to a bottom portion of the reactor or combustor for subsequent recirculation without external and internal recycle conduits.

28 Claims, 10 Drawing Sheets

CIRCULATING FLUIDIZED BED REACTOR WITH INTERNAL PRIMARY PARTICLE SEPARATION AND RETURN

FIELD OF THE INVENTION

The present invention relates, in general, to circulating fluidized bed (CFB) reactors or combustors having impact type particle separators and, more particularly, to a CFB reactor or combustor design having an internal impact type primary particle separator and internal return of all primary collected solids to a bottom portion of the reactor or combustor for subsequent recirculation without external and internal recycle conduits.

BACKGROUND OF THE INVENTION

The use of impact type particle separators to remove solid material entrained in a gas is well known. Typical examples of such particle separators are illustrated in U.S. Pat. No. 2,083,764 to Weisgerber, U.S. Pat. No. 2,163,600 to How, U.S. Pat. No. 3,759,014 to Van Dyken, II et al., U.S. Pat. No. 4,253,425 to Gamble, et al., and U.S. Pat. No. 4,717,404 to Fore.

Particle separators for CFB reactors or combustors can be categorized as being either external or internal. External type particle separators are located outside the reactor or combustor enclosure; see, for example U.S. Pat. No. 4,165,717 to Reh, et al., U.S. Pat. No. 4,538,549 to Stromberg, U.S. Pat. Nos. 4,640,201 and 4,679,511 to Holmes et al., U.S. Pat. No. 4,672,918 to Engstrom, et al., and U.S. Pat. No. 4,683,840 to Morin. Internal type particle separators are located within the reactor or combustor enclosure; see, for example U.S. Pat. Nos. 4,532,871 and 4,589,352 to Van Gasselt, et al., U.S. Pat. Nos. 4,699,068, 4,708,092 and 4,732,113 to Engstrom, and U.S. Pat. No. 4,730,563 to Thornblad.

These latter internal type separators either involve baffles across the entire freeboard space that would be difficult to unclog and support or they involve an internal baffle and chute arrangement which closely resembles the external type of particle separators.

FIGS. 1–4 are schematics of known CFB boiler systems used in the production of steam for industrial process requirements and/or electric power generation. Fuel and sorbent are supplied to a bottom portion of a furnace 1 contained within enclosure walls 2, which are normally fluid cooled tubes. Air 3 for combustion and fluidization is provided to a windbox 4 and enters the furnace 1 through apertures in a distribution plate 5. Flue gas and entrained particles/solids 6 flow upwardly through the furnace 1, releasing heat to the enclosure walls 2. In most designs, additional air is supplied to the furnace 1 via overfire air supply ducts 7.

Several variations of particle separation and return to the furnace 1 are known. The FIG. 1 system has an external cyclone primary separator 8, a loop seal 9, and optional secondary collection discussed infra. The systems of FIGS. 2–4 typically provide two stages of particle separation. FIG. 2 has a first stage external impact type particle collector 10, particle storage hopper 11, and L-valve 12; FIGS. 3–4 employ in-furnace impact type particle separators or U-beams 13 and external impact type particle separators or U-beams 14. The in-furnace U-beams return their collected particles directly into the furnace 1, while the external U-beams return their collected particles into the furnace via the particle storage hopper 11 and L-valve 12, collectively referred to as a particle return system 15. An aeration port 16 supplies air for controlling the flow rate of solids or particles through the L-valve 12.

The flue gas and solids 6 pass into a convection pass 17 which contains convection heating surface 18. The convection heating surface 18 can be evaporating, economizer, or superheater as required.

In the FIG. 1 system, an air heater 19 extracts further heat from the flue gas and solids 6; solids escaping the external primary cyclone separator 8 may be collected in a secondary collector 20 or baghouse 21 for recycle 22,23 or disposal as required. Systems in FIGS. 2–4 typically use a multiclone dust collector 24 for recycle 25 or disposal as required, and air heaters 26 and baghouses 27 are also used for heat extraction and ash collection, respectively.

In CFB reactors, reacting and non-reacting solids are entrained within the reactor enclosure by the upward gas flow which carries solids to the exit at the upper portion of the reactor where the solids are separated by internal and/or external particle separators. The collected solids are returned to the bottom of the reactor commonly by means of internal or external conduits. A pressure seal device (typically a loop seal or L-valve) is needed as a part of the return conduit due to the high pressure differential between the bottom of the reactor and the particle separator outlet. The separator at the reactor exit, also called the primary separator, collects most of the circulating solids (typically from 95% to 99.5%). In many cases an additional (secondary) particle separator and associated recycle means are used to minimize the loss of circulating solids due to inefficiency of the primary separator.

U.S. Pat. No. 4,992,085 to Belin, et al discloses the internal impact type particle separator shown in FIGS. 3–4 of the present application discussed above. It is comprised of a plurality of concave impact members supported within the furnace enclosure and extending vertically in at least two rows across the furnace exit opening, with collected particles falling unobstructed and unchannelled underneath the collecting members along the enclosure wall. This separator has proven effective in increasing the average density in a CFB combustor without increasing the the flow of externally collected and recycled solids. This has been done, while providing simplicity of the separator structural arrangement, absence of clogging, and uniformity of the gas flow at the furnace exit. The latter effect is important to prevent local erosion of the enclosure walls and in-furnace heating surfaces like wingwalls caused by impingement of a high velocity gas-solids stream.

In this known embodiment, the internal impact type particle separator, comprised of two rows of impingement members, is typically used in combination with a downstream external impact type particle separator from which collected solids are returned to the furnace by an external conduit. The external impact type particle separator and associated particle return means, e.g., the particle storage hopper and L-valve, are needed since the efficiency of the internal impact type particle separator, comprised typically of two rows of impingement members, is not sufficient to prevent excessive solids carryover to the downstream convection gas pass which may cause erosion of the convection surfaces and an increase of the required capacity of the secondary particle collection/recycle equipment.

It is known that the efficiency of an impact type particle separator increases when the number of rows of impingement members increases from two to four or five. One arrangement of an internal impact type particle separator is disclosed in U.S. Pat. No. 4,891,052 to Belin, et al. However, the efficiency of the internal impact type particle separator of U.S. Pat. No. 4,891,052 cannot be improved by simply increasing the number of rows because of a) greater reentrainment of the discharged solids by gases, with the upward gas velocity increasing sharply in the direction to the center of the furnace, and b) increasing bypass gas flow through the discharge area of the impingement members.

It is apparent that a CFB reactor or combustor could be made more simple and less costly by a design which provided for entirely internal primary particle separation and return, thus eliminating the need for any external particle return means.

SUMMARY OF THE INVENTION

A central purpose of the present invention is to provide a CFB reactor or combustor with an internal impact type primary particle separator located within the reactor enclosure and internal return of all primary collected solids to a bottom portion of the reactor or combustor for subsequent recirculation without external and internal recycle conduits.

Accordingly, one aspect of the present invention is drawn to a circulating fluidized bed reactor. A reactor enclosure is provided, partially defined by enclosure walls and having a bottom portion, an upper portion, and an exit opening located at an outlet of the upper portion. A primary, impact type particle separator is supported within the upper portion of the reactor enclosure, for collecting particles entrained within a gas flowing within the reactor enclosure from the lower portion to the upper portion, causing them to fall towards the bottom portion of the reactor. Cavity means are connected to the primary, impact type particle separator and located entirely within the reactor enclosure, for receiving collected particles as they fall from the primary, impact type particle separator. Finally, returning means, connected to the cavity means and located entirely within the reactor enclosure, are provided for returning particles from the cavity means directly and internally into the reactor enclosure so that they free fall unobstructed and unchanneled down along the enclosure walls to the bottom portion of the reactor for subsequent recirculation.

By this construction, a desired density of the flowing gas/solids mixture in the furnace is obtained, resulting in enhanced furnace heat transfer rates, improved carbon conversion efficiency, and improved sorbent utilization. These effects are accomplished while simultaneously eliminating a major capital expense for the previously required external primary particle recycle system (particle storage hopper, L-valve, and associated control elements). Significant savings can thus be achieved in structural steel and other elements associated with the CFB reactor, as well in the plant area and volume required for the CFB reactor.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

As used herein, the term CFB combustor refers to a type of CFB reactor where a combustion process takes place. While the present invention is directed particularly to boilers or steam generators which employ CFB combustors as the means by which the heat is produced, it is understood that the present invention can readily be employed in a different kind of CFB reactor. For example, the invention could be applied in a reactor that is employed for chemical reactions other than a combustion process, or where a gas/solids mixture from a combustion process occurring elsewhere is provided to the reactor for further processing, or where the reactor merely provides an enclosure wherein particles or solids are entrained in a gas that is not necessarily a byproduct of a combustion process.

Figure 5:
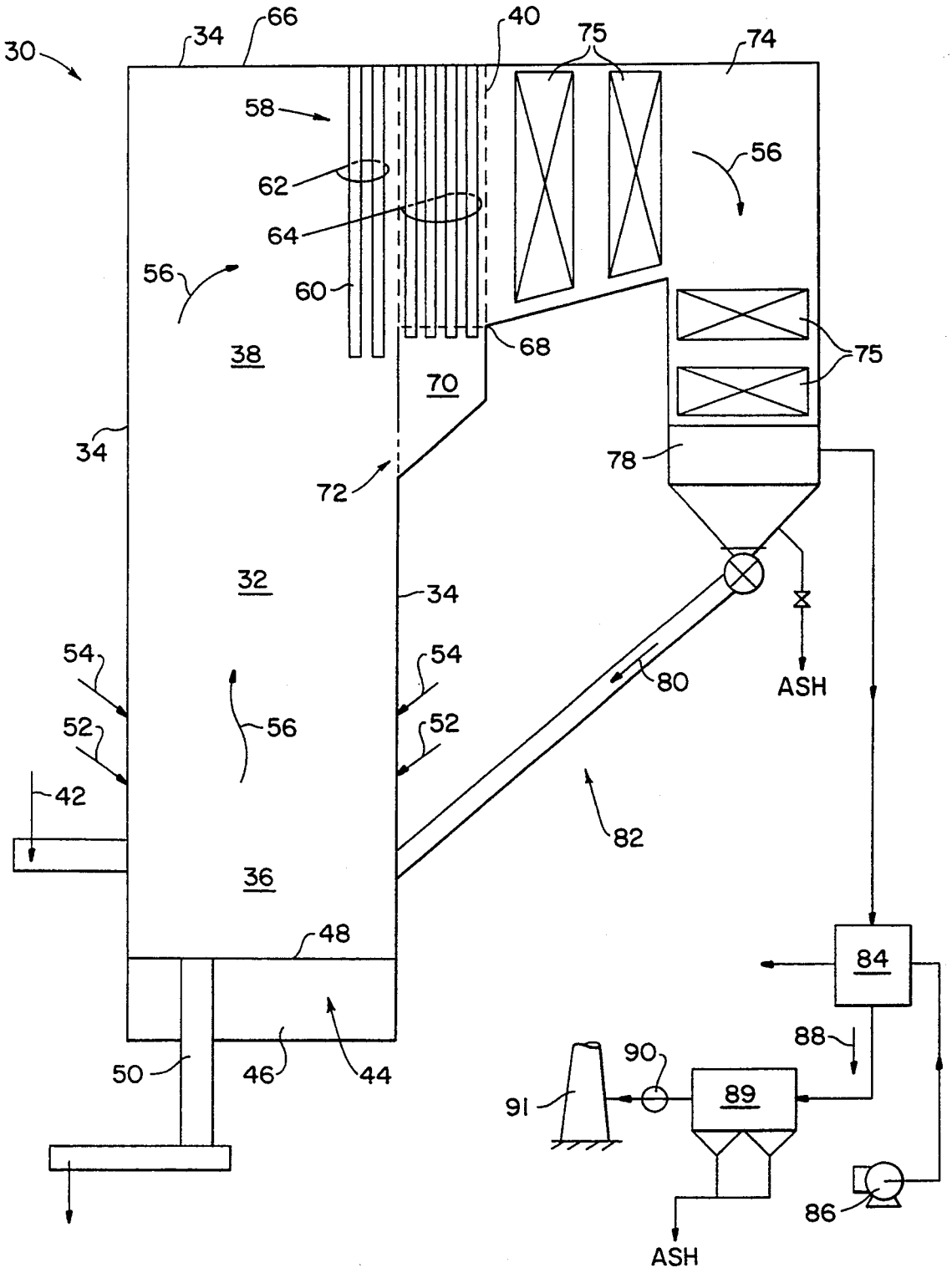
FIG. 5 is a schematic sectional side view of a CFB boiler having a combustor or reactor enclosure according to one embodiment of the invention.

Referring to the drawings generally, wherein like numerals designate the same element throughout the several drawings, and to FIG. 5 in particular, there is shown a circulating fluidized bed (CFB) boiler 30 having a first embodiment of the present invention. In the following discussion, the front of the CFB boiler 30 or reactor enclosure 32 is defined as the left hand side of FIG. 5, the rear of the CFB boiler 30 or reactor enclosure 32 is defined as the right hand side of FIG. 5, and the width of the CFB boiler 30 or reactor enclosure 32 is perpendicular to the plane of the paper on which FIG. 5 is drawn; other drawings will use the same convention as applicable.

The CFB boiler 30 has a furnace or reactor enclosure 32, typically rectangular in cross-section, and partially defined by fluid cooled enclosure walls 34. The enclosure walls are typically tubes separated from one another by a steel membrane to achieve a gas-tight enclosure 32. The reactor enclosure 32 is further defined by having a lower portion 36, an upper portion 38, and an exit opening 40 located at an outlet of the upper portion 38. Fuel, such as coal, and sorbent, such as limestone, indicated at 42, are provided to the lower portion 36 in a regulated and metered fashion by any conventional means known to those skilled in the art. By way of example and not limitation, typical equipment that would be used include gravimetric feeders, rotary valves and injection screws. Primary air, indicated at 44, is provided to the lower portion 36 via windbox 46 and distribution plate 48 connected thereto. Bed drain 50 removes ash and other debris from the lower portion 36 as required, and overfire air supply ports 52,54 supply the balance of the air needed for combustion.

A flue gas/solids mixture 56 produced by the CFB combustion process flows upwardly through the reactor enclosure 32 from the lower portion 36 to the upper portion 38, transferring a portion of the heat contained therein to the fluid cooled enclosure walls 34. A primary, impact type particle separator 58 is located within the upper portion 38 of the reactor enclosure 32. In a preferred embodiment, the primary, impact type particle separator 58 comprises four to six rows of concave impingement members 60, arranged in two groups—an upstream group 62 having two rows and a downstream group 64 having two to four rows, preferably three rows. Members 60 are supported from roof 66 of the reactor enclosure 32 and are designed according to the teachings of U.S. Pat. No. 4,992,085, the specification of which is hereby incorporated by reference.

As set forth in U.S. Pat. No. 4,992,085, impingement members 60 are non-planar; they may be U-shaped, E-shaped, W-shaped or any other shape as long as they have a concave surface. The first two rows of members 60 are staggered with respect to each other such that the flue gas/solids 56 passes through them enabling the entrained solid particles to strike this concave surface; the second two to four rows of members 60 are likewise staggered with respect to each other. In the preferred embodiment, the upstream group 62 of impingement members 60 will collect particles entrained in the gas and cause them to free fall internally and directly down towards the bottom portion 36 of the reactor enclosure 32, against the crossing flow of flue gas/solids 56.

Impingement members 60 are positioned within the upper portion 38 of the reactor enclosure 32 fully across and just upstream of exit opening 40. Besides covering exit opening 40, each impingement member 60 in downstream group 64 also extends beyond a lower elevation or workpoint 68 of exit opening 40 by approximately one foot. In the preferred embodiment, however, and in contrast to the impingement members 60 of upstream group 62, the lower ends of the impingement members 60 in downstream group 64 extend into a cavity means 70, located entirely within the reactor enclosure 32, for receiving collected particles as they fall from the downstream group 64. Various embodiments of the cavity means 70 of the invention and its interconnection with the impingement members 60 are discussed below.

The particles collected by downstream group 64 must also be returned to the bottom portion 36 of the reactor enclosure 32. Returning means 72 are thus provided, connected to the cavity means 70 and also located entirely within the reactor enclosure 32. Returning means 72 returns particles from the cavity means 70 directly and internally into the reactor enclosure 32 so that they fall unobstructed and unchanneled down along the enclosure walls 34 to the bottom portion 36 of the reactor enclosure 32 for subsequent recirculation. In this embodiment, the cavity means 70 functions as more of a temporary transfer mechanism, rather than as a place where particles are stored for any significant period of time. By causing the particles to fall along the enclosure walls 34, the possibility of reentrainment in the upwardly flowing gas/solids 56 passing through the reactor enclosure 32 is minimized. Various embodiments of the returning means 72 of the invention and its connection to cavity means 70 are discussed below.

It is thus seen that the foregoing construction achieves primary particle separation from the flowing gas/solids mixture 56 without the need for any external particle storage hopper, interconnecting conduits, or L-valves, which are typically required in the prior art.

Connected to the exit opening 40 of the reactor enclosure 32 is convection pass 74. After passing first across upstream group 62 and then across downstream group 64, the flue gas/solids 56 (whose solids content has been markedly reduced, but which still contains some fine particles not removed by the primary, impact type particle separator 58) exits the reactor enclosure 32 and enters convection pass 74. Located within the convection pass 74 is the heat transfer surface 75 required by the particular design of CFB boiler 30. Various arrangements are possible; the arrangement shown in FIG. 5 is but one type. Different types of heat transfer surface 75, such as evaporating surface, economizer, superheater, or air heater and the like could also be located within the convection pass 74, limited only by the process steam or utility power generation requirements and the thermodynamic limitations known to those skilled in the art.

After passing across all or a part of the heating surface in the convection pass 74, the flue gas/solids 56 is passed through a secondary particle separation device 78, typically a multiclone dust collector, for removal of most of the particles 80 remaining in the gas. These particles 80 are also returned to the lower portion 36 of the reactor enclosure 32 by means of a secondary particle return system 82. The cleaned flue gas is then passed through an air heater 84 used to preheat the incoming air for combustion provided by a fan 86. Cooled and cleaned flue gas 88 is then passed to a final particle collector 89, such as an electrostatic precipitator or baghouse, through an induced draft fan 90 and stack 91.

Figure 8:
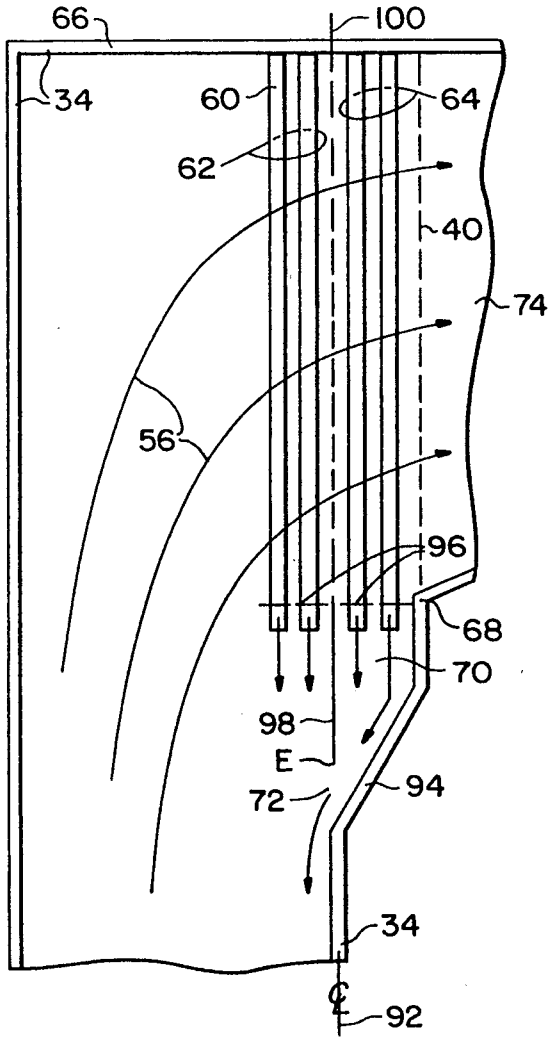
FIGS. 6, 7, and 8 are schematic sectional side views of the upper portion of a CFB reactor according to further embodiments of the invention.
Figure 7:
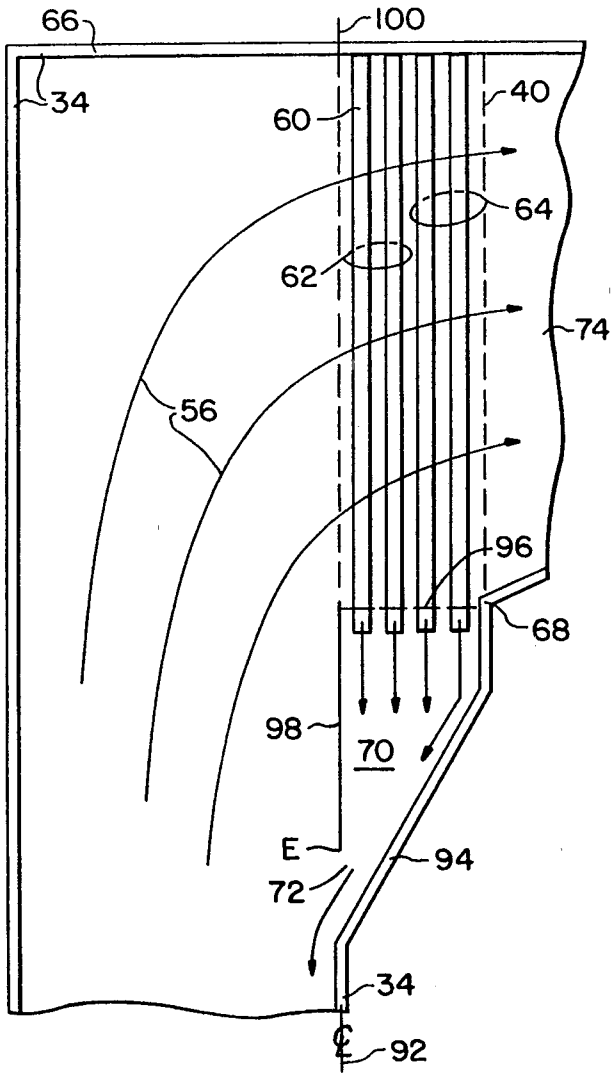
Figure 6:
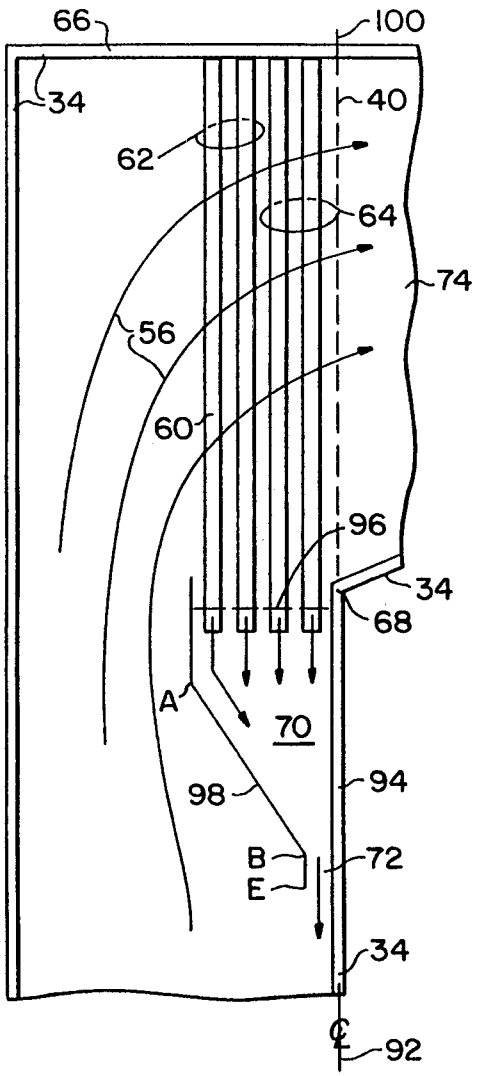

The various embodiments of the cavity means 70 and returning means 72 according to the present invention will now be discussed. FIGS. 6, 7, and 8 are schematic sectional views of the upper portion of a CFB reactor having different embodiments of the present invention. The principal differences between these embodiments involve: (1) the particular location of the cavity means 70, with respect to a vertical centerline 92 of a rear enclosure wall 94, (2) whether one or both groups 62, 64 of impingement members 60 discharge their collected particles into the cavity means 70, and (3) the number of impingement members 60 in each group 62, 64.

As indicated earlier, the enclosure walls 34, including rear enclosure wall 94, are typically made of fluid cooled tubes separated from one another by a steel membrane to achieve a gastight enclosure 32. CFB boilers 30 of the type herein are usually top supported from structural steel members (not shown) that connect to the vertical enclosure walls 34. The enclosure walls 34 are thus fluid cooled, load carrying members. Some of the tubes forming the rear enclosure wall 94 thus must go up vertically to and through the roof 66, as shown at 100, to be connected via hangers to the structural steel. The balance of the tubes forming the rear enclosure wall 94 are bent at workpoint 68 to form a fluid cooled floor for the convection pass 74.

In FIG. 6, cavity means 70 is located entirely within reactor enclosure 32, and inside of the vertical centerline 92, and being further defined by the rear enclosure wall 94, baffle plates 96, and a front cavity wall 98, and collects all the particles collected by both upstream and downstream groups 62, 64 of impingement members 60. At its upper end, the front cavity wall 98 overlaps the lower ends of the impingement members 60 by a foot or more. Front cavity wall 98 is bent at A and B so that a lower end E thereof forms the cavity means into a funnel shape whose outlet is adjacent rear enclosure wall 94 and represents a first embodiment of returning means 72. In a preferred embodiment, front cavity wall 98 may be made of metal plate, and one embodiment of returning means 72 would be a rectangular slot or series of appropriately sized spaced apertures extending along a width of the reactor enclosure 32. However, front cavity wall 98 may be also formed from some of the fluid cooled tubes bent out of the plane of the rear enclosure wall 94, the gaps therebetween being connected to one another by membrane or plate. Returning means 72 would take the form of appropriately sized apertures between adjacent tubes along the width of the reactor enclosure 32 at the point where they are bent out of the plane of the rear enclosure wall 94.

Baffle plates 96 are provided near the bottom of impingement members 60, positioned at or below workpoint 68. Baffle plates 96 are typically horizontal and provide a top portion of cavity means 70 and the connection to the impingement members 60 comprising the primary, impact particle separator 58. Baffle plates 96 would be designed much along the lines of the baffle plate 26 described in U.S. Pat. No. 4,992,085. In particular, particles collected in impingement members 60 would flow downward through small openings in baffle plates 96, which are configued to cover the top of cavity means 70, but not the concave area within each impingement member 60, thereby preventing possible reentrainment of particles into the gas as it flows across the top of cavity means 70.

FIG. 7 is similar to the embodiment of FIG. 6, the major difference being that the cavity means 70 is located externally of the vertical centerline 92 of rear enclosure wall 94. Here, returning means 72 is achieved by bending the rear enclosure wall 94 which, together with an end E of straight front cavity wall 98, forms the cavity means 70 into a funnel shape whose outlet is again adjacent rear enclosure wall 94. Front cavity wall 98 could be formed of metal plate, returning means 72 comprising a longitudinal slot or a plurality of spaced apertures between the lower end E and the rear enclosure wall 94. Alternatively, front cavity wall 98 could be comprised of fluid cooled tubes extending straight up to and through the roof 66, as shown at 100. In this case, the returning means 72 would comprise apertures between adjacent tubes along the width of the reactor enclosure 32 at the point where the balance of the tubes forming the rear enclosure wall 94 are bent out of the plane of the vertical centerline 92 of rear enclosure wall 94.

The embodiments of FIGS. 6 and 7 allows the use of the necessary number of impingement members 60 required for high collection efficiency, while still providing for completely internal solids return to the bottom portion 36 of the reactor enclosure 32 for subsequent recirculation without the use of external or internal return conduits or particle return systems.

FIG. 8 shows another embodiment of the invention, as shown in FIG. 5, and in a preferred embodiment employs at least four rows of impingement members 60, arranged in two groups 62,64. The first two rows of impingement members 60 forming the upstream group 62 discharge their collected solids directly into the reactor enclosure 32 for a free fall along the rear enclosure wall 94, while the solids collected by the downstream group 64 fall into the cavity means 70, again located entirely within the reactor enclosure 32, and located externally with respect to the vertical centerline 92 of the rear enclosure wall 94. Baffle plates 96 would again be employed, serving as the top portion of the cavity means 70 and as a baffle on the front two rows of impingement members 60 forming the upstream group 62. Baffle plates 96 on upstream group 62 cause the gas/solids flow 56 to flow across the impingement members 60, and prevents any gas bypassing or flowing directly upward along the impingement members 60, as taught in U.S. Pat. No. 4,992,085. This arrangement further simplifies the primary, impact type separator 58 design and makes it more compact compared to that of FIG. 6. In addition, this arrangement helps to increase the efficiency of the primary, impact type separator 58 by providing a separate solids discharge from the first two rows from the subsequent rows. This reduces the bypass gas flow between the upstream group 62 and the downstream group 64 and ensuing particle reentrainment.

Figure 9:
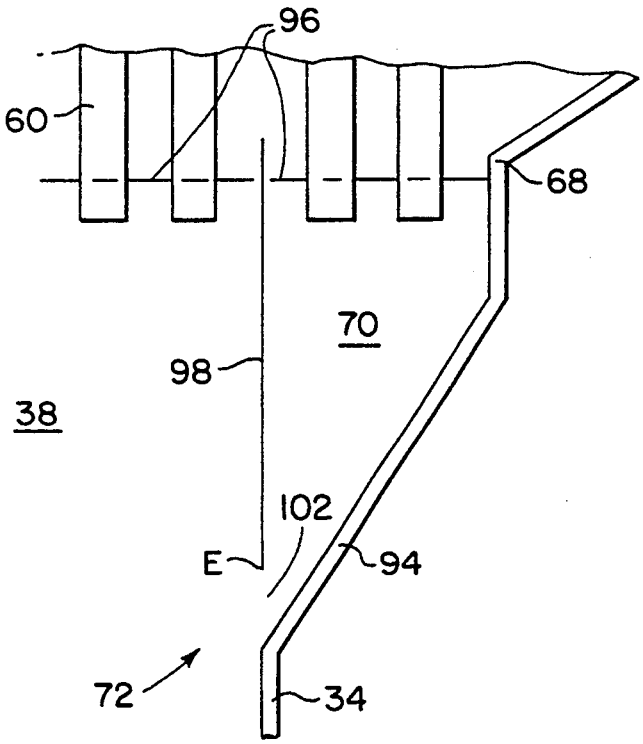
FIGS. 9 and 10 are close-up schematic views of the embodiment in FIG. 8, FIG. 10 taken in direction A of FIG. 9.
Figure 10:
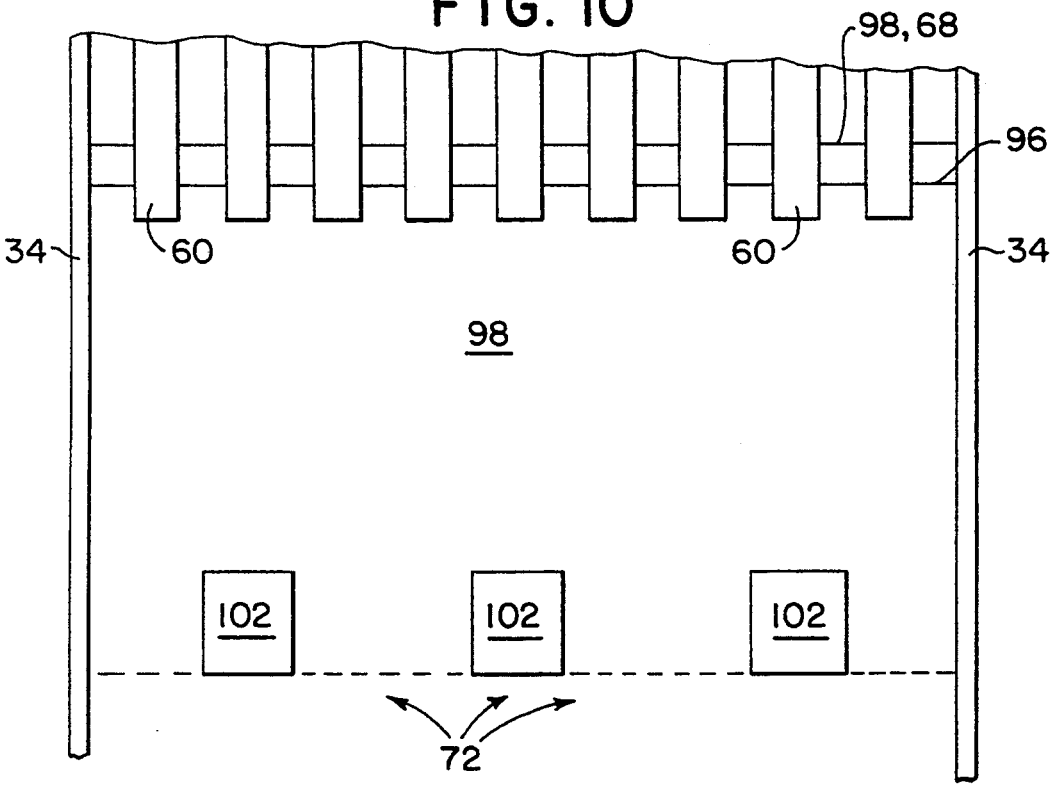
Figure 11:
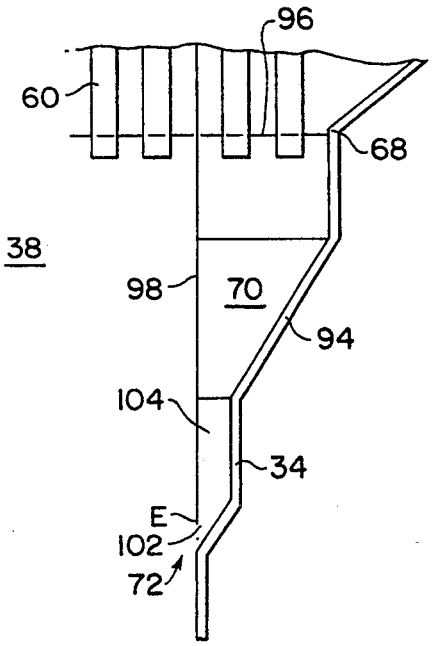
FIGS. 11, 12, and 13 are schematic views of still other embodiments of the invention, FIG. 12 taken in direction A of FIG. 11, and FIG. 13 being a plan view of FIG. 11.
Figure 12:
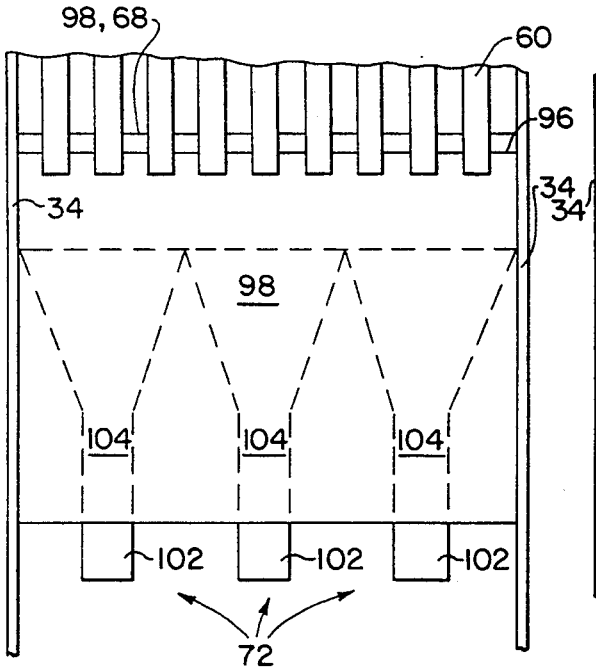
Figure 13:
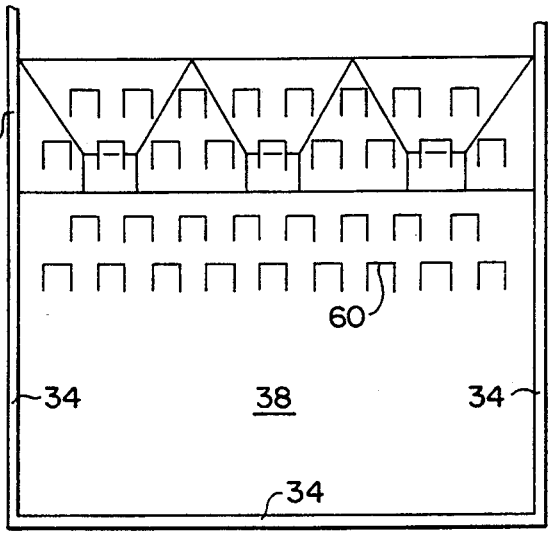
Figure 14:
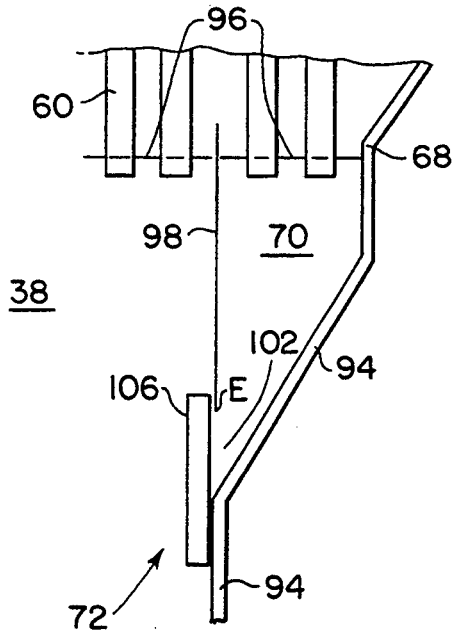
FIGS. 14, 15, and 16 are schematic views of still further embodiments of the invention, FIG. 15 being section I—I of FIG. 14, and FIG. 16 being a plan view of FIG. 14.
Figure 15:
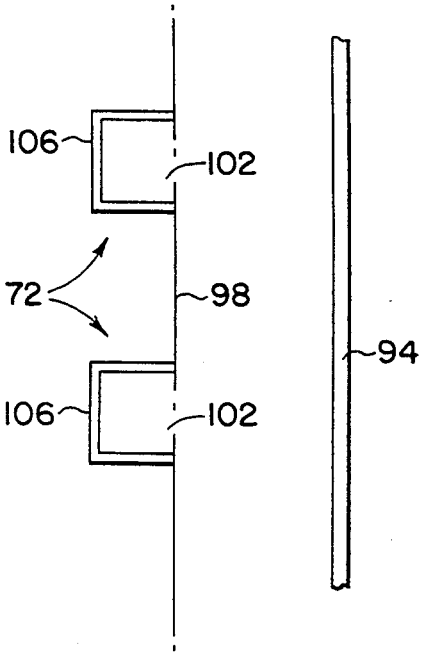
Figure 16:
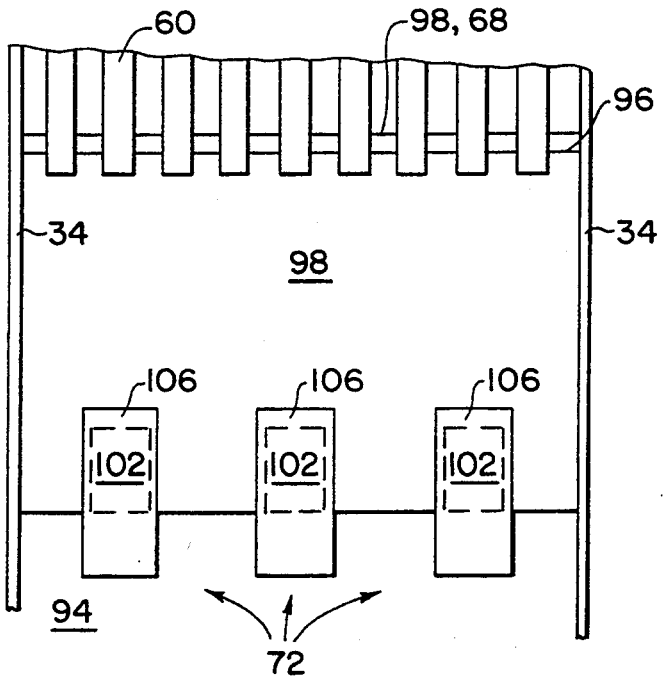

Preventing or minimizing gas bypassing through the returning means 72 is also required, for the same reason that the baffle plates 96 are installed at the front two rows of impingement members 60 in FIG. 8. FIGS. 9 and 10 disclose that appropriately sized discharge openings 102 in returning means 72 can accomplish this objective, while also providing evacuation of the collected solids without their accumulation in the cavity means 70. FIGS. 11, 12, and 13 disclose that appropriately sized channels 104 formed in rear enclosure wall 94, in combination with discharge openings 102, are also suitable. FIGS. 14, 15, and 16 disclose that short vertical channels 106 attached to the front cavity wall 98 directly opposite the discharge openings 102 will also prevent gas bypassing into the cavity means 70, while further enhancing return of the solids to the lower portion 36 of the reactor enclosure 32 in free fall vertically along the rear enclosure wall 94.

Figure 1:
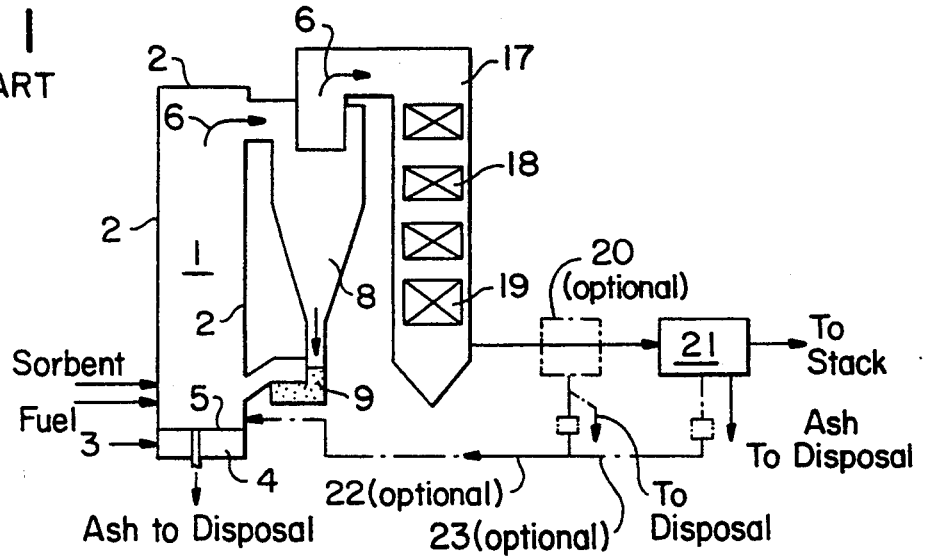
FIG. 1 PRIOR ART
FIG. 1 is a schematic of a known circulating fluidized bed (CFB) boiler system having an external, cyclone type primary particle separator having a loop seal.
Figure 2:
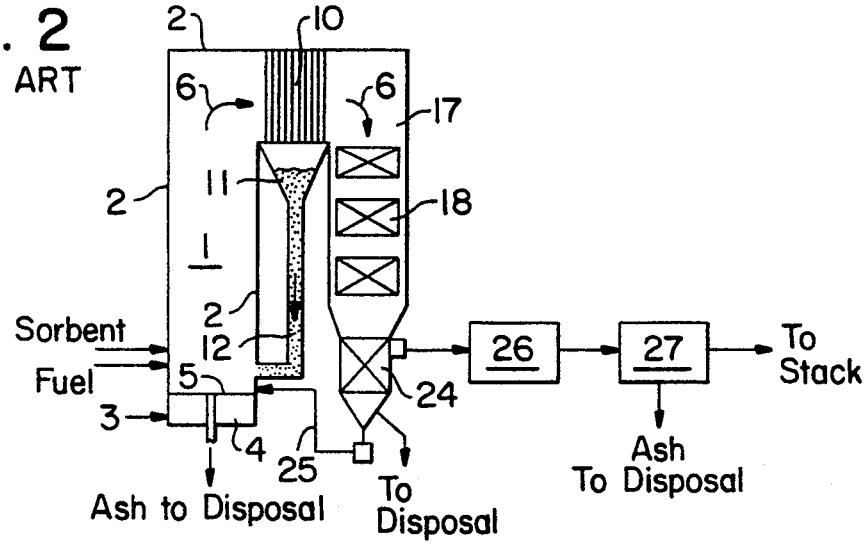
FIG. 2 PRIOR ART
FIG. 2 is a schematic of a known CFB boiler system having an external, impact type primary particle separator, a non-mechanical L-valve and a secondary (multiclone) particle separator.
Figure 3:
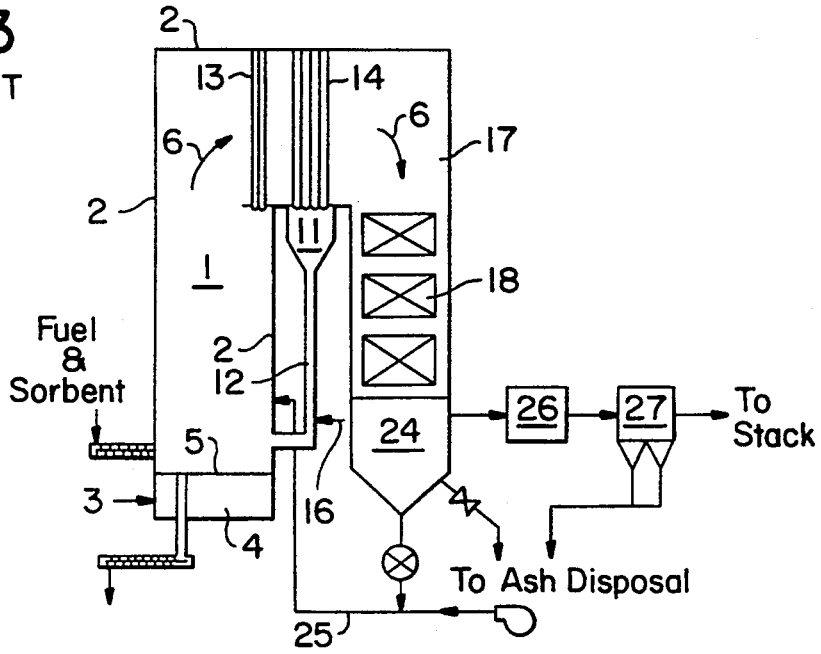
FIG. 3 PRIOR ART
FIG. 3 is a schematic of a known CFB boiler system having both internal and external impact type primary particle separators, a non-mechanical L-valve, and a secondary (multiclone) particle separator.
Figure 4:
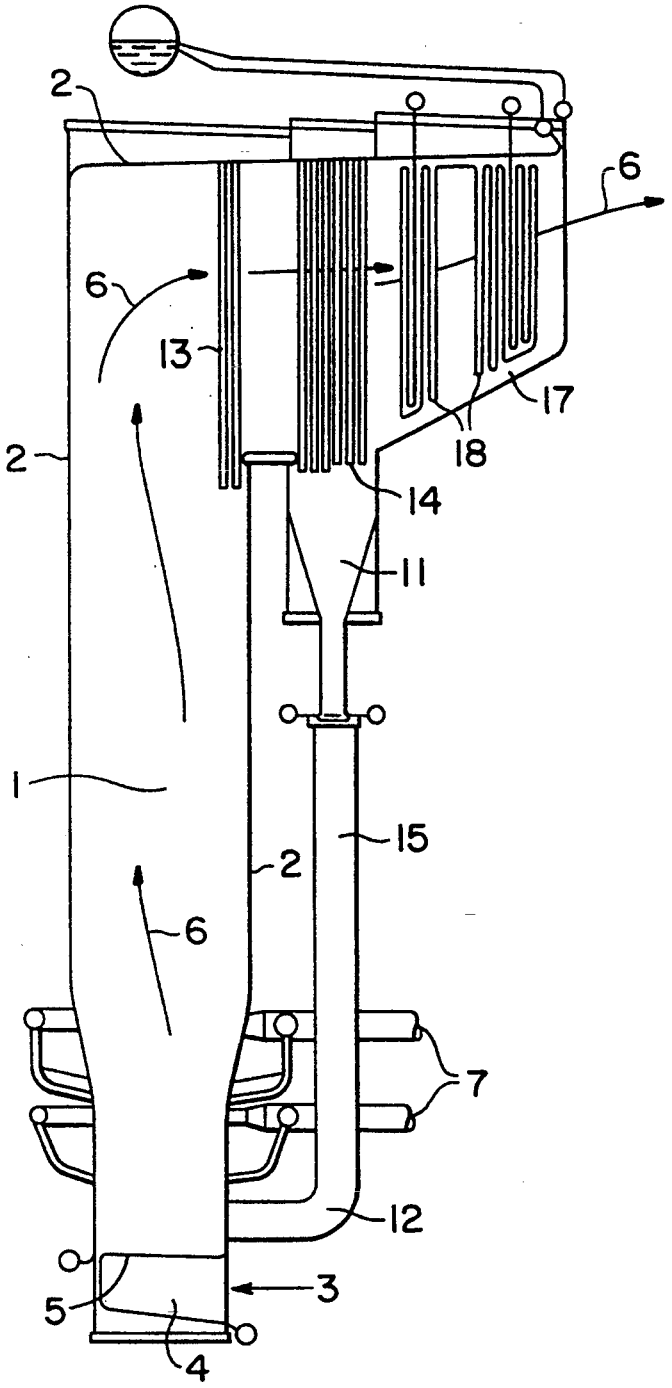
FIG. 4 PRIOR ART
FIG. 4 is a schematic of a CFB boiler design similar to that shown in FIG. 3.

The flow area of the discharge openings 102 of the returning means 72 is preferably selected to provide a solids mass flux of 100 to 500 $kg/m^2s$. For the channels 104, their length should be preferably 6–10 times of the expected pressure differential across the cavity means 70 discharge openings 102 expressed in inches of water column. The pressure seal provided by the aforementioned solids return arrangements is simplified as compared to loop seals or L-valves used in known CFB applications where solids are returned from the separator to the bottom of the reactor by conduits. This is possible due to the relatively small pressure differential between upper furnace 38 and cavity means 70, as compared to the pressure differential between the lower furnace of a CFB and a hot cyclone separator of FIG. 1 or the particle storage hopper 11 of FIGS. 2–4. An estimated pressure differential value for the present invention is 1.0–1.5 inches water column, versus the typical pressure differential value of 25–30 or even 40–45 inches water column for the known CFB combustor applications.

Figure 17:
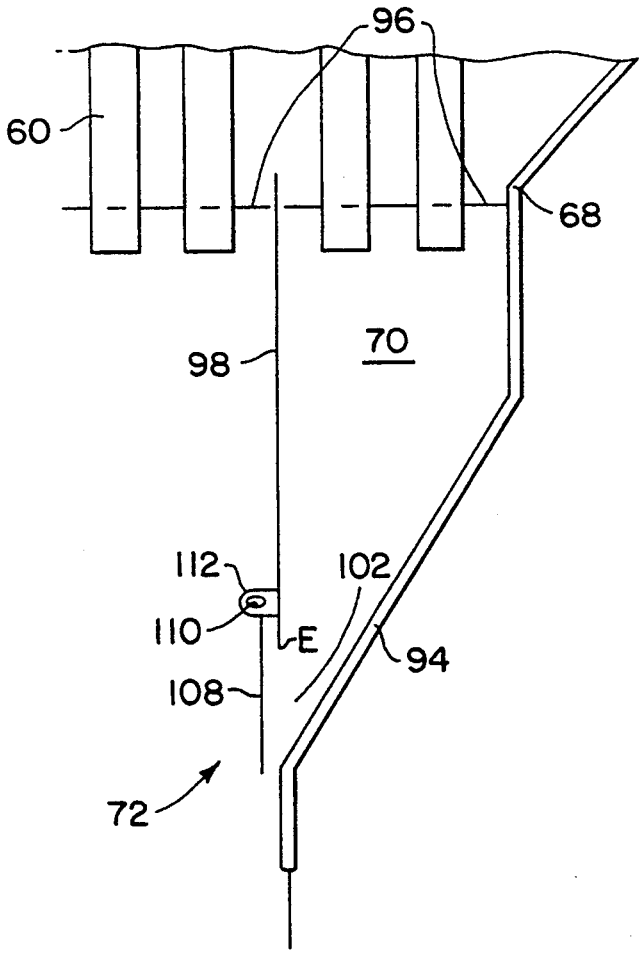
FIGS. 17 and 18 are schematic views of another embodiment of the invention, FIG. 18 taken in direction A of FIG. 17.
Figure 18:
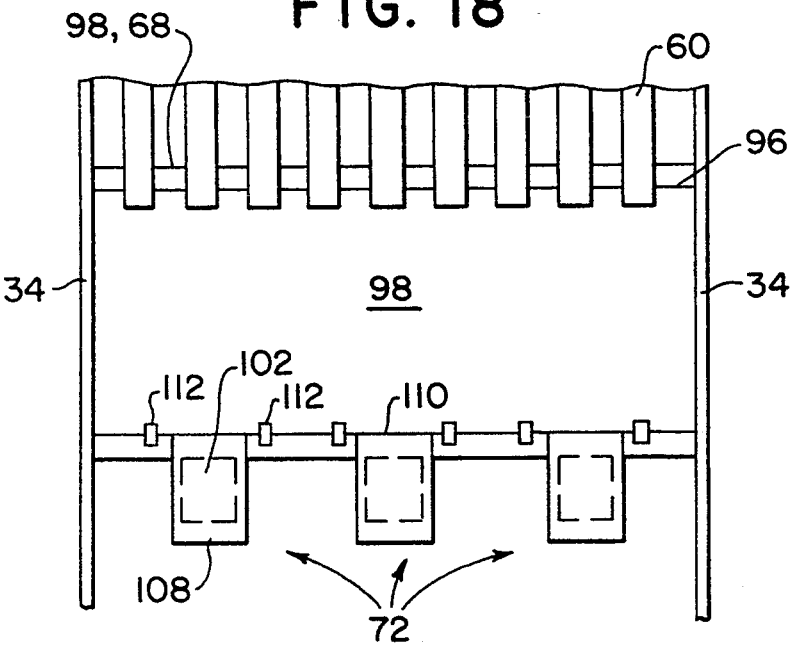

FIGS. 17–18 disclose an embodiment of returning means 72 where a flapper valve 108 could be placed over each discharge opening 102, pivotally attached to the front cavity wall 98 by means of a pin 110 and bosses 112. The flapper valve 108 will self-adjust the cross-section of the openings to allow solids evacuation from the cavity means 70 without gas bypassing into same. Sizing of the discharge openings 102 would preferably be in accordance with the criteria described earlier.

Figure 19:
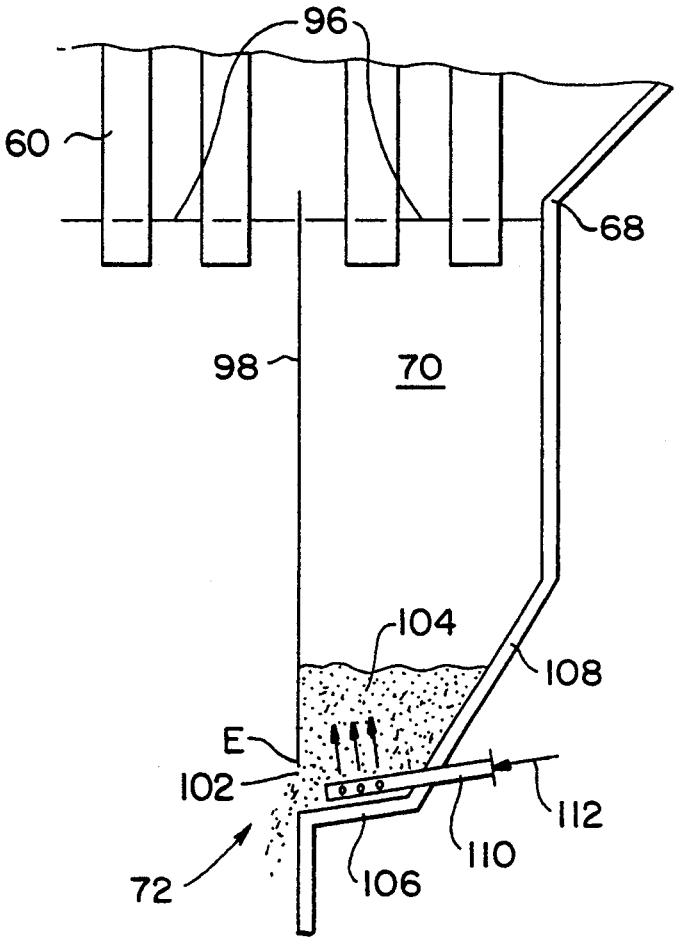
FIGS. 19 and 20 are schematic views of yet another embodiment of the invention, FIG. 20 taken in direction A of FIG. 19.
Figure 20:
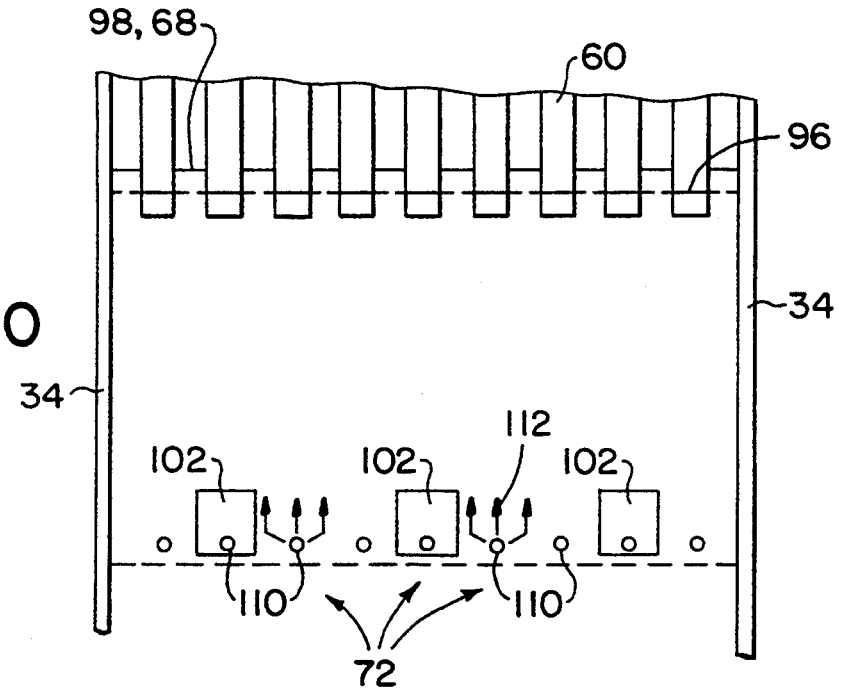

FIGS. 19–20 disclose another embodiment of returning means 72 where the discharge opening 102 is further restricted so that a bed of circulating solids 104 is formed. The bed 104 is supported by a slightly inclined floor 106, 108 through which a plurality of sparge air pipes 110 project beneath the bed of circulating solids 104. Fluidizing air, gas or the like 112 injected into the bed 104 keeps the bed at a desired level by fluidizing the particles and causing them to continually empty from the cavity 70. The bed of solids, maintained as packed or slightly fluidized will provide a pressure seal which would prevent gas 56 bypassing through the discharge openings 102.

Figure 21:
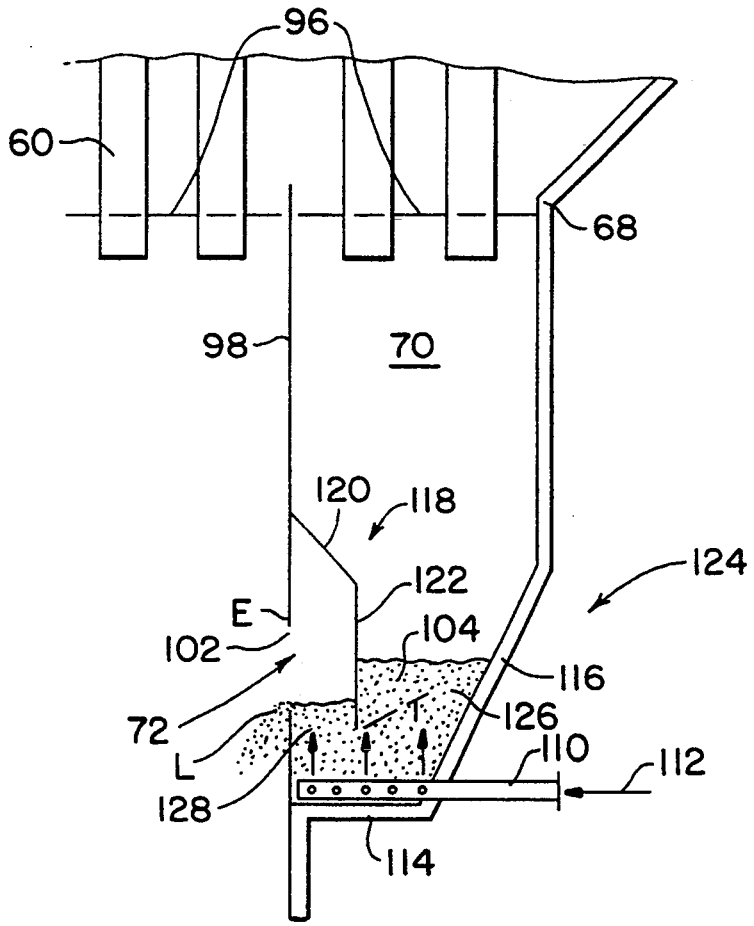
FIGS. 21 and 22 are schematic views of yet still another embodiment of the invention, FIG. 22 taken in direction A of FIG. 21.
Figure 22:
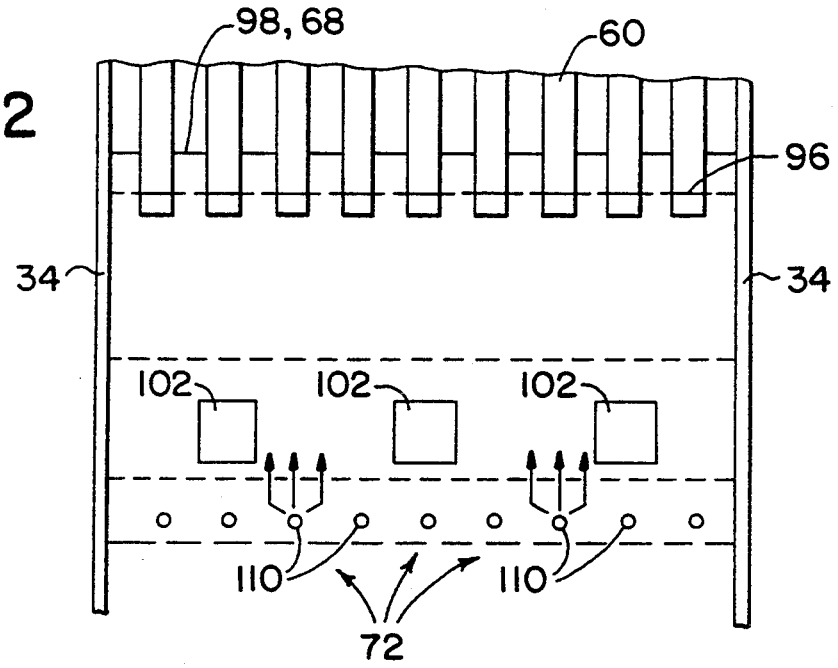

A variation on the pressure seal arrangement of FIGS. 19–20 is shown in FIGS. 21–22. In this embodiment, a lower edge L of the discharge openings 102 is placed above a floor 114 of the cavity 70; an inclined portion 116 extends up from the floor 114. A baffle plate 118 having a first portion 120 connected to the front cavity wall 98 and a second portion 122 connected thereto extends into the cavity 70. A lower end T of the second portion 122 is located so that it is lower than the lower edge L of the discharge opening 102, thereby forming a loop type seal 124 having a feed chamber 126 and a discharge chamber 128 defined by the front cavity wall 98, floor 114, 116, baffle plate 118 and cavity wall 116. Fluidizing air, gas or the like 112 is injected into the bed 104 of particles by means of sparge pipes 110 as was the case in FIGS. 19–20. The solids level in the discharge chamber 128 will be at or slightly above lower edge L, with solids overflowing and falling down along the reactor rear wall. The solids level in the feed chamber 126 will be self adjusting to balance the pressure differential between the upper portion 38 of the reactor enclosure 32 and the cavity 70. Since this differential is comparatively small, only a low fluidizing gas pressure is needed in both the embodiments of FIGS. 19–20 and 21–22 to provide the CFB bed pressure seal as compared to the gas pressure required for loop type seals for return legs known in the art.

The present invention thus results in a simple CFB reactor or combustor arrangement which eliminates the need for external primary separators and their associated solids return conduits, and loop seals or L-valves. Another advantage of this invention is that elimination of the aforementioned structures provides enhanced access to the bottom portion 36 of the CFB reactor or combustor, unobstructed with solids return conduits. In CFB combustors specifically, this provides the possibility for more uniform fuel and sorbent feed, thus improving the combustion and emission performance, and also provides for better access if more than one fuel is being fired.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving circulating fluidized bed reactors or combustors, or to the replacement, repair or modification of existing circulating fluidized bed reactors or combustors. In some embodiments of the invention, certain features of the invention may sometimes be used to advantage without a corresponding use of the other features. Accordingly, all such changes and embodiments properly fall within the scope of the following claims.

We claim:

1. A circulating fluidized bed reactor, comprising:

a reactor enclosure partially defined by enclosure walls and having a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion;

cavity means, connected to the primary, impact type particle separator and located entirely within the reactor enclosure, for receiving collected particles as they fall from the primary, impact type particle separator; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation.

2. The reactor of claim 1, further comprising means for supplying fuel and sorbent to the lower portion of the reactor enclosure.

3. The reactor of claim 1, further comprising a windbox connected to the lower portion of the reactor enclosure.

4. The reactor of claim 1, wherein the primary, impact type particle separator comprises rows of concave impingement members.

5. The reactor of claim 4, wherein all rows of concave impingement members cause the particles collected from the gas to fall directly into the cavity means.

6. The reactor of claim 4, wherein the rows of concave impingement members are arranged in two groups, an upstream group and a downstream group, each group having at least two rows of concave impingement members.

7. The reactor of claim 6, wherein the upstream group of impingement members collects particles entrained in the gas and causes them to free fall internally and directly towards the bottom portion of the reactor enclosure.

8. The reactor of claim 6, wherein the downstream group of impingement members collects particles entrained in the gas and causes them to fall directly into the cavity means.

9. The reactor of claim 1, wherein the reactor enclosure has a rear enclosure wall having a vertical centerline and the cavity means is located within the reactor enclosure inside of the vertical centerline.

10. The reactor of claim 9, wherein the cavity means is defined by the rear enclosure wall, a baffle plate, and a front cavity wall.

11. A circulating fluidized bed reactor, comprising:

a reactor enclosure partially defined by enclosure walls and having a rear enclosure wall having a vertical centerline, a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion;

cavity means, defined by the rear enclosure wall, a baffle plate, and a front cavity wall having a lower end thereof bent towards the rear enclosure wall to form the cavity means into a funnel shape whose outlet is adjacent the rear enclosure wall, connected to the primary, impact type particle separator and located entirely within the reactor enclosure inside of the vertical centerline, for receiving collected particles as they fall from the primary, impact type particle separator; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation.

12. A circulating fluidized bed reactor, comprising:

a reactor enclosure partially defined by enclosure walls and having a rear enclosure wall having a vertical centerline, a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion;

cavity means, defined by the rear enclosure wall, a baffle plate, and a front cavity wall, the rear enclosure wall being made of fluid cooled tubes and the front cavity wall being formed from some of the fluid cooled tubes bent out of a plane of the rear enclosure wall to form the cavity means into a funnel shape whose outlet is adjacent the rear enclosure wall, connected to the primary, impact type particle separator and located entirely within the reactor enclosure inside of the vertical centerline, for receiving collected particles as they fall from the primary, impact type particle separator; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation.

13. A circulating fluidized bed reactor, comprising:

a reactor enclosure partially defined by enclosure walls and having a rear enclosure wall having a vertical centerline, a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion;

cavity means, connected to the primary, impact type particle separator and located entirely within the reactor enclosure but outside of the vertical centerline, for receiving collected particles as they fall from the primary, impact type particle separator; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation.

14. A circulating fluidized bed reactor, comprising:

a reactor enclosure partially defined by enclosure walls and having a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion, the primary, impact type particle separator having rows of concave impingement members arranged in two groups, an upstream group having at least two rows of concave impingement members which collects particles entrained in the gas and causes them to free fall internally and directly towards the bottom portion of the reactor enclosure, the upstream group having a baffle plate to prevent gas bypassing or flowing directly upward along its impingement members, and a downstream group having at least two rows of impingement members which collects particles entrained in the gas and causes them to fall directly into cavity means connected thereto and located entirely within the reactor enclosure, for receiving collected particles as they fall from the downstream group of the primary, impact type particle separator, the cavity means having a baffle plate serving as a top portion of the cavity means; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation.

15. A circulating fluidized bed reactor, comprising:

a reactor enclosure partially defined by enclosure walls and having a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion;

cavity means, defined by rear enclosure wall, a baffle plate, and a front cavity wall, connected to the primary, impact type particle separator and located entirely within the reactor enclosure, for receiving collected particles as they fall from the primary, impact type particle separator; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation, the returning means including a plurality of discharge openings arranged along a width of the reactor enclosure and having a flow area sized to provide a solids mass flux of 100–500 kg/m$^2$s.

16. A circulating fluidized bed reactor, comprising:

a reactor enclosure partially defined by enclosure walls and having a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion;

cavity means, defined by a rear enclosure wall, a baffle plate, and a front cavity wall, connected to the primary, impact type particle separator and located entirely within the reactor enclosure, for receiving collected particles as they fall from the primary, impact type particle separator; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation, the returning means including a plurality of discharge openings arranged along a width of the reactor enclosure between an end of the front cavity wall and the rear enclosure wall and a short vertical channel attached to the front cavity wall directly opposite the discharge openings to prevent gas bypassing into the cavity means and to enhance return of solids to the lower portion of the reactor enclosure in free fall vertically along the rear enclosure wall.

17. A circulating fluidized bed reactor, comprising:

a reactor enclosure partially defined by enclosure walls and having a bottom portion, an upper portion, and an exit opening located at an outlet of the upper portion;

a primary, impact type particle separator located within the upper portion of the reactor enclosure, for collecting particles entrained within a gas flowing within the reactor enclosure from the lower portion to the upper portion thereof, causing them to fall towards the bottom portion;

cavity means, defined by a rear enclosure wall, a baffle plate, and a front cavity wall, connected to the primary, impact type particle separator and located entirely within the reactor enclosure, for receiving collected particles as they fall from the primary, impact type particle separator; and returning means, connected to the cavity means and located entirely within the reactor enclosure, for returning particles from the cavity means directly and internally into the reactor enclosure so that they free fall unobstructed and unchanneled down along the enclosure walls to the bottom portion of the reactor enclosure for subsequent recirculation, the returning means including a plurality of discharge openings arranged along a width of the reactor enclosure between an end of the front cavity wall and the rear enclosure wall and a flapper valve placed over each discharge opening, pivotally attached to the front cavity wall.

18. The reactor of claim 11, wherein the returning means is a rectangular slot or series of appropriately sized spaced apertures extending between the lower end of the front cavity wall and the rear enclosure wall along a width of the reactor enclosure.

19. The reactor of claim 12, wherein the returning means takes the form of appropriately sized apertures between adjacent tubes along the width of the reactor enclosure at the point where they are bent out of the plane of the rear enclosure wall.

20. The reactor of claim 13, wherein the cavity means is defined by the rear enclosure wall, a baffle plate, and a front cavity wall.

21. The reactor of claim 20, wherein the front cavity wall is straight and the rear enclosure wall is bent away from the vertical centerline of the rear enclosure wall to form the cavity means into a funnel shape whose outlet is adjacent the rear enclosure wall.

22. The reactor of claim 21, wherein the returning means is a rectangular slot or series of appropriately sized spaced apertures extending between a lower end of the front cavity wall and the rear enclosure wall along a width of the reactor enclosure.

23. The reactor of claim 21, wherein the rear enclosure wall is made of fluid cooled tubes and the front cavity wall is straight and formed from some of the fluid cooled tubes extending along the vertical centerline up towards a roof of the reactor enclosure.

24. The reactor of claim 23, wherein the returning means comprises apertures between adjacent tubes along a width of the reactor enclosure at the point where some of the fluid cooled tubes are bent out of the plane of the rear enclosure wall.

25. The reactor of claim 15, wherein the returning means further comprises channels formed in the rear enclosure wall in combination with the discharge openings.

26. The reactor of claim 4, wherein the impingement members are U-shaped, E-shaped, W-shaped or of some other similar concave configuration.

27. The reactor of claim 22, further including a plurality of sparge pipes projecting into the cavity means to keep a level of particles within the cavity means at a desired level by fluidizing the particles and causing them to continually empty from the cavity means.

28. The reactor of claim 27, further including a baffle plate connected to the front cavity wall and extending into the cavity means to form a loop type seal having a feed chamber and a discharge chamber defined by the front cavity wall, a floor of the cavity means, the baffle plate and a rear cavity wall.

* * * * *